US006517450B1

(12) United States Patent
Klyve

(10) Patent No.: US 6,517,450 B1
(45) Date of Patent: Feb. 11, 2003

(54) BAND PUTTER

(75) Inventor: Jon Klyve, Bergen (NO)

(73) Assignee: Clyve AS, Bergen (NO)

( * ) Notice: Subject to any disclaimer, the term of this patent is extended or adjusted under 35 U.S.C. 154(b) by 0 days.

(21) Appl. No.: 09/807,206

(22) PCT Filed: Oct. 15, 1999

(86) PCT No.: PCT/NO99/00314

§ 371 (c)(1),
(2), (4) Date: Jun. 13, 2001

(87) PCT Pub. No.: WO00/27483

PCT Pub. Date: May 18, 2000

(30) Foreign Application Priority Data

Oct. 23, 1998 (NO) ..... 19984934

(51) Int. Cl.[7] ..... A63B 53/04; A63B 53/06; A63B 53/08

(52) U.S. Cl. ..... 473/340; 473/324; 473/329

(58) Field of Search ..... 473/236, 235, 473/231, 219, 248, 251, 329, 340

(56) References Cited

U.S. PATENT DOCUMENTS

| | | | | |
|---|---|---|---|---|
| 777,400 A | | 12/1904 | Clark | |
| 890,836 A | | 6/1908 | Beale | |
| 925,389 A | * | 6/1909 | Royce | 473/329 |
| 2,111,249 A | | 3/1938 | Plese | |
| 4,113,249 A | | 9/1978 | Beery | |
| 4,422,638 A | | 12/1983 | Tucker | |
| 5,190,290 A | | 3/1993 | Take | |
| 5,316,304 A | | 5/1994 | Yost | |
| 5,332,214 A | | 7/1994 | Tucker | |
| 5,437,447 A | * | 8/1995 | Rigutto | 473/251 |
| 5,464,212 A | | 11/1995 | Cook | |
| 5,501,453 A | | 3/1996 | Hurst | |
| 5,643,109 A | | 7/1997 | Rose et al. | |
| 5,899,819 A | | 5/1999 | Mount et al. | |

FOREIGN PATENT DOCUMENTS

GB 2281041 A 2/1995

* cited by examiner

*Primary Examiner*—Paul T. Sewell
*Assistant Examiner*—M. Chambers
(74) *Attorney, Agent, or Firm*—Rothwell, Figg, Ernst & Manbeck

(57) ABSTRACT

A golf club of the putter type, with a club head (11) with at the outset a level, vertical or largely vertically positioned strike area (19). The strike area (19) is arranged as a long-shaped, lengthways extended interchangeable/replaceable tension bar (15), which is clamped to two fastening clamps at the opposite ends of the club head (11) by means of the two opposite end parts (18*a* and 18*b*) of the lengthways extended interchangeable/replaceable tension bar. The lengthways extended interchangeable/replaceable part has, in an area between the two opposite end parts (18*a* and 18*b*), a main part (15*a*) which extends freely over a hollow (11*e*) in the club head (11).

4 Claims, 2 Drawing Sheets

BAND PUTTER

BACKGROUND OF THE INVENTION

This invention relates to a golf club of the "putter" type, with a club head which has a level, or largely level, strike area. When using a putter to put a golf ball on a putting green, the golfer usually strikes the ball applying a non-spinning stroke to move the golf ball along a desired path which gives it a rolling movement along the grass on a plane parallel with the plane of the roll. When a golf ball is to be putted into the intended hole it is important that the ball is given a controlled path of movement, preferably with a controlled roll in the direction of movement. In this connection, the aim is normally to give the ball an even rolling movement over the surface, i.e. with rolling contact with the grass on the green, and preferably without causing the ball to jump unintentionally on the grass. Using this invention, the aim is to give the golf ball an intentional spin as soon as the stroke is played. In other words, it is desirable—at least with certain putting strokes—to transfer a large part of the kinetic energy from the golf club to the golf ball thereby causing the ball to take on a spinning movement, i.e. instead of applying a non-spinning stroke to the ball, a stroke is played which gives the ball a combined thrust and spinning movement. Until now, the golf ball has been given an intentional spin of this kind by, for example, holding the strike area of the putter at an appropriately oblique angle. Alternatively, the putter can "top" the golf ball by striking it at a level above its the horizontal mid-plane. The strike area of the putter normally has a vertical position when the putter is in a normal vertical position in connection with a putting stroke. But by having the strike area at an oblique angle in relation to the vertical plane one may deliberately seek to create great friction between the golf ball and the grass of the green already in the very first phase of the ball's rolling movement as a result of the obliquely angled stroke played against the golf ball. Consequently, the aim is to apply as controlled a spin as possible to the golf ball at an early stage in the movement of the golf ball. In practice, however, in many cases the point at which the spin starts after the stroke has been played is a matter of chance, and also the degree of spin, since after being struck by the golf club the golf ball, in certain cases, may be given a rapid upward lifting movement from the underlying surface and may therefore make a subsequent soaring movement in relation to the underlying surface. Thus, the golf ball is given a limited or more or less uncontrollable spin. Until now, the position of the strike area of the putter in relation to the golf ball has been very decisive for the movement of the golf ball in relation to the underlying surface. However, local conditions (humidity/dampness, unevenness etc.) on the green affect, to a varying degree, the friction of the golf ball and thereby its speed of movement and pattern of movement, including the spin movement and the speed of the spin. When the player's putter stroke meets the golf ball in an area above the horizontal mid-plane of the ball, the golf ball may experience an element of downward force in the direction of the grass on the green, with the result that one achieves intentionally greater friction and an intentional spin on the golf ball at an early stage of the stroke, thereby allowing the ball to roll in an intentional spinning plane and obtaining the gyro effect. Further, when the player places the strike area of the putter at an oblique angle upwards and forward, it is possible, by applying this intentional initial friction against the grass, to ensure that a controlled pattern of movement of the golf ball is achieved in more or less continuous contact with the grass during the rolling movement. On the other hand, if, for example, the player places the strike area of the putter at an oblique angle upwards and backward, it is possible to give the golf ball an intentional soaring or jumping movement, in cases where this is desired.

SUMMARY OF THE INVENTION

Using this invention, the aim is to arrive at a solution whereby the putter can give the golf ball a relatively soft and sensitive stroke whereby the gyro effect is obtained at an early stage after the stroke. The level of power transferred is adjustable and where the putter, in this connection, can easily give the golf ball the exactly desired movement by giving it the intended spin and the desired gyro effect. The aim is to ensure that the intended spin movement of the golf ball can be effected directly from the strike area of the putter, i.e. at an early stage in the stroke of the putter against the actual golf ball and with easy and sensitive control of the stroke and to overcome the inertia force of the ball. This can be achieved by arranging the strike area of the putter in such a way that an interchangeable/replaceable longitudinal, lengthwise extended tension bar is attached to two fastening points at each end of the putter head through the two opposite ends of the tension bar, and with the lengthwise tension bar, attached through the two opposite ends, stretching freely over a hollow in the putter head. Using, the lengthwise extended tension bar, which extends freely over a hollow in the putter head, it is possible to achieve some softening of the putter stroke against the golf ball and at the same time have the possibility of giving an initial spin to the golf ball immediately on striking the ball. According to the invention, by ensuring that the said tension bar is locally pliable it is possible to achieve a relatively extensive, i.e. a relatively wide strike area between the putter head and the golf ball. By giving the said tension bar a relatively smooth and low-friction strike surface it is possible to ensure that there is low friction between the putter head and the golf ball in order to deliberately cause the golf ball to have the intended spinning movement. This can also be further controlled, for example by raising or lowering the putter head in relation to the centre of gravity of the ball. A delayed transfer of the force (kinetic energy) from the putter head to the ball will give a smoother and softer stroke. This greatly affects the ball and causes the ball to spin immediately after the stroke. The spin is desirable immediately after the stroke in order to obtain the gyro effect, which in turn gives better stability both in direction and length. Other features of this invention are shown in the following description with reference to the accompanying drawings, as follows:

DETAILED DESCRIPTION

Figure 1:
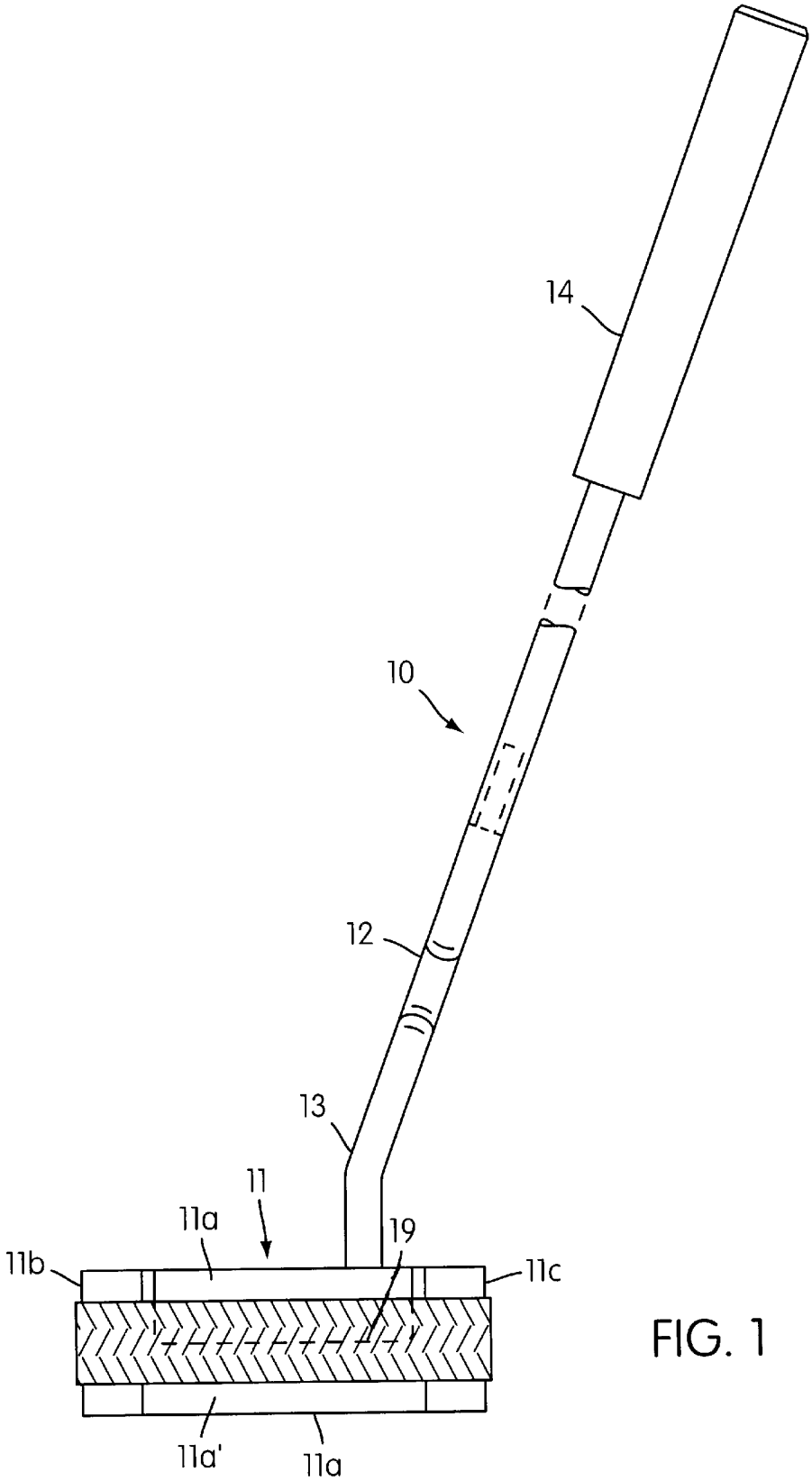
FIG. 1 is a drawing of a golf club of the putter type, as seen facing the strike area of the club head.
Figure 2:
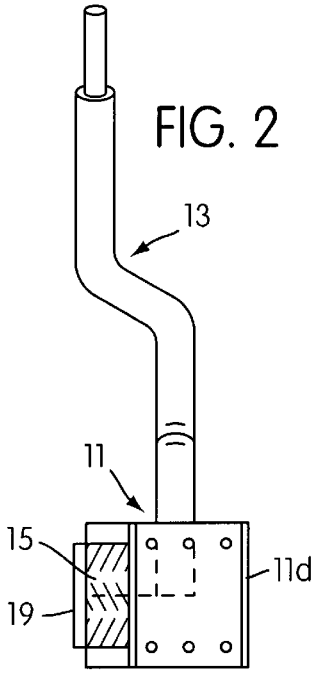
FIG. 2 is an end section of the club head.
Figure 3:
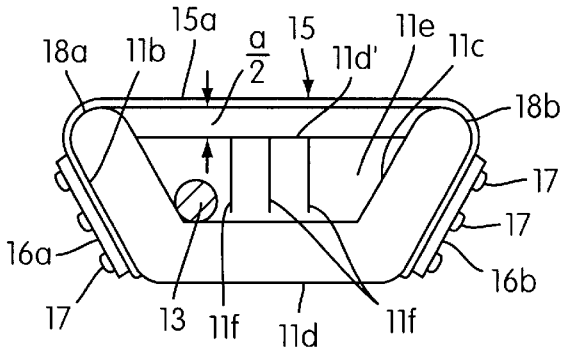
FIG. 3 is a plan drawing of the club head.

FIG. 1 shows a golf club 10 of the putter type, consisting of a club head 11, connected to a shaft section 12 by means of a transitional part 13 which may be angled in different directions. The shaft section 12 is shown with a traditional hand grip 14.

This particular case relates to a putter with a putter head which can be adjusted in different ways relatively simply. In accordance with the adjustment requirements laid down by the "Royal and Ancient Golf Club of St. Andrews" and the "United States Golf Association", the weight of other golf clubs than putters may be adjusted. However, as regards putters, other adjustments may be made in accordance with the following:

(I) It must not be possible to make the adjustment easily.

(II) All adjustable parts shall be fixed firmly in place during use so that there is no reasonable possibility of parts loosening or of them actually being re-adjusted during use/play.

(III) All results of adjustments made must be in accordance with stipulated rules.

Figure 4:
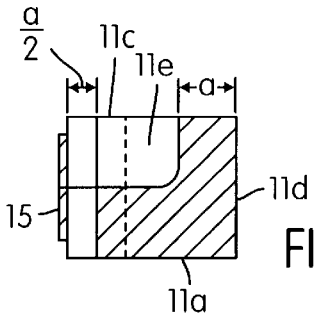
FIG. 4 is a vertical section of the club head.
Figure 5:
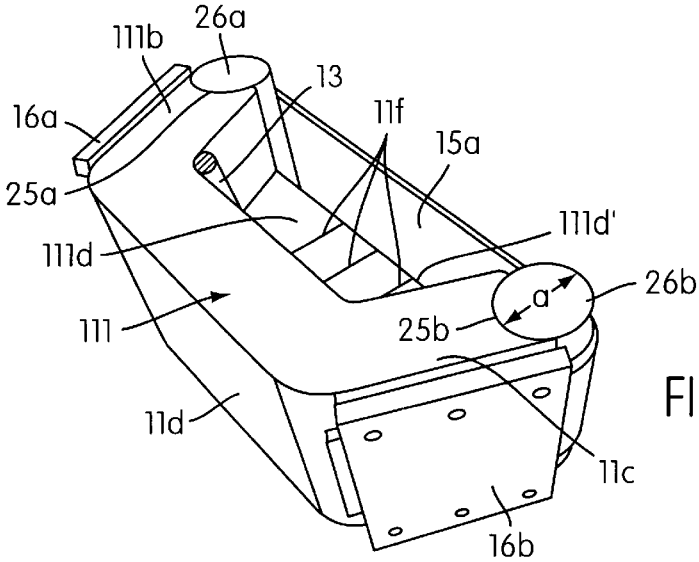
FIG. 5 is a perspective drawing of a modified version of the putter head.
Figure 6:
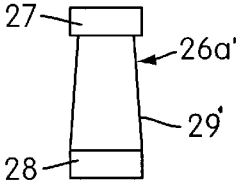
FIGS. 6–8 show alternative forms that may be implemented in the putter head as shown in FIG. 5.
Figure 7:
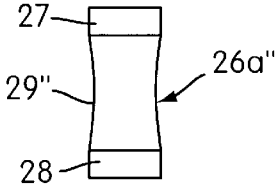
Figure 8:
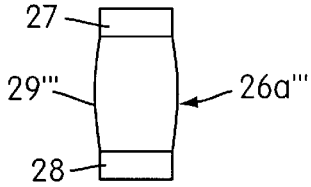

The conclusion is that the functional properties of a golf club (in this connection also including a putter) cannot be changed during play and that any change during play will entail the disqualification of the player from the game in play. According to the invention, the golf club (the putter) is described and shown taking account of the permitted adjustments, as mentioned above. In other words, according to the invention, the different versions and the different alternative parts provide the possibility of making a number of different adjustments, including the interchange/replacement of different parts and some adjustment of the parts in relation to each other. It is envisaged that adjustments of this kind will be made in a workshop, or using special tools, thereby—as intended—making it difficult to adjust the putter during use/play. The actual club head 11, in accordance with the version shown, is made of light metal, such as an aluminum alloy, while the interchangeable/replaceable part in the club head which is the actual strike area may be made of another material. The club head 11 in the version shown has a stiff and stable part made of light metal and with a relatively flat bottom part 11*a* from which two end walls 11*b* and 11*c* extrude, and between which is a back part lid, and which three parts 11*b*, 11*c* and 11*d* together mark the limits of the hollow space 11*e*. The end walls 11*b* and 11*c* converge obliquely outwards from the back part at an angle of about 75° from the back part 11*d* and extrude to a height of, for example a/2 in front of the front side 11*a*' of the bottom part 11*a*. The bottom part 11*a*, the end walls 11*b* and 11*c* and the back part 11*d* are shown with an internal wall thickness a, as shown in FIG. 4. Internally, on the bottom part 11*a* of hollow 11*e*, are shown three marked sighting lines 11*f*. An interchangeable/replaceable part in the form of a band-shaped, long-shaped part 15, here called a tension bar, is attached at its opposite ends using clamp plates 16*a* and 16*b*, respectively, and the appropriate fastening screws 17, to the obliquely backward angled sides 11*a*' and 11*b*' of the end walls 11*b* and 11*c* of the club head. The fastening screws 17 should preferably not pass through the tension bar 15, and in this connection are shown as two rows of screws along each end of the tension bar. A relatively rough surface is used on the inward-facing surface of the clamp plates 16*a* and 16*b*, and preferably also on the adjoining backward angled sides 11*a*' and 11*b*' of the related end walls 11*b* and 11*c*, thereby ensuring that the tension bar 15 is firmly attached. According to the invention, with the version shown, the aim is to devise an especially simple, barely concealed, and relatively uncomplicated club head construction and a relatively simple interchangeable/replaceable part which is firmly attached to the club head construction. The tension bar 15 is attached to the club head 11 preferably with an exactly measured, permanent tensile strength. The tensile strength is determined using a tension device, details of which are not shown. The tension bar extends from the point of attachment between the respective clamp plates 16*a* and 16*b* and the related end walls 11*b* and 111*c*, and bends around each rounded end 18*a* and 18*b*. Between the rounded ends 18*a* and 18*b* the tension bar extends freely across the said hollow le with a mid-strike area 19 for a golf ball. During use/play, the clamp plates 16*a* and 16*b* are a permanent point of attachment for the tension bar 15, since it is intended that the clamp plates 16*a* and 16*b* will not be tampered with at times when they are to be left alone. The tension bar 15 is shown with its main part 15*a* extending freely between the rounded ends 18*a* and 18*b* to create a very tense strike surface 19 which permits some local deformation when it is struck or strikes against a golf ball. The process of inducing the tension in the tension bar can be performed using a separate tension device, preferably one which has a special pointer to show the tensile strength of the tension bar 15 before it is held fast by the clamp plates 16*a* and 16*b*. During installation of the tension bar 15 the opposite ends of the tension bar are attached on the inside to a tension device which, in a way not shown here, can create a support against the back part 11*d* of the club head 11. After the tensile strength in the tension bar 15 has been set in connection with club head 11, the tension bar is attached to the club head 11 using the clamp plates, and the connection between the tension bar and the tension device is cut, including any superfluous parts of the tension bar. In order to be able to regulate the tensile strength of the tension bar 15 at a later date, it is therefore necessary to have a separate regulating device. Accordingly, an attempt has been made to make it impossible to re-regulate the tensile strength during play. In practice, changing the tensile strength means changing the entire tension bar and then setting the tensile strength of the new tension bar at the desired level, and finally cutting the connection between the tension bar and the tension device. In cases where it is necessary to diverge from the requirement calling for ease of subsequent regulation of the tensile strength during use, it is clear that there are several ways of modifying the means of attaching the tension bar and the ways of regulating the tensile strength, although no examples are shown here. Alternatively (without showing further details here), it would be possible to incorporate the regulating device or relevant regulating devices in the club head itself, but preferably with appropriate covering of the regulating device/devices, using a detachable screw cover, or similar. An alternative method of regulation of this kind would necessarily, and in any event to some extent, complicate the construction of the club head and the general design, and would also affect the weight of the club head. In the version shown, the tension bar 15 consists of bar material with a high tensile strength in a longitudinal direction and preferably with low or very limited longitudinal elasticity. The bar material may itself consist, for example, of fibre material with a high tensile strength in the form of a bar in woven form. In the latter case a certain elasticity may be achieved in the weaving, for example locally in the weaving, and more specifically, locally in the actual strike area 19 of the tension bar 15. In addition, locally in the strike area 19, as a consequence of the woven structure, it is possible to achieve the desired low degree of friction, and thereby the desired effective friction effect between the surface of strike area 19 and the golf ball. Alternatively, the tension bar 15 may be made of metal, plastic or other suitable material with a high tensile strength, such as a composite material with certain tension-absorbing components and other more elastic components. For instance, the tension bar 15 may have a greater tensile strength, for example by having a greater bar thickness in the areas at or around the length-ends than in the intermediate bar area, especially the middle area of the bar. FIG. 5 is a perspective drawing of alternative club head 111, whose end sections 116*a* and 116*b* terminate more or less flush with the front side 111*d*' of the bottom part 111*d*. In this alternative version the aim is to be able to replace some other interchangeable parts as required. Specifically, the end edges of end sections 16*a* and 16*b* are designed with their respective positions 25*a* and 25*b* to fit each of their interchangeable parts 26*a* and 26*b* which with their circumference area extend a distance of a/2 beyond the front side 111*d*' of the bottom part 111*d*. In FIG. 5 the interchangeable parts 26*a* and 26*b* are shown with a cylindrical outside surface with diameter a. In such a case, much the same effect will be achieved as with the rounded end edges 18*a* and 18*b* in the version shown in FIGS. 1–4. FIGS. 6, 7 and 8 show a perspective of the different alternative designs for interchangeable parts 26*a*', 26*a*" and 26*a*'" where they differ from each other in certain respects. Other differences are also possible, but they are not shown here. In practice, for example, there may be small dimensional differences or more locally limited differences in the outside surface of the interchangeable parts. The first modified interchangeable part 26*a*', as shown in FIG. 6, has cylindrical end sections 27 and 28 with diameter a and a conical mid-section 29'. This therefore gives the possibility of inducing different tension strengths in the ends of the tension bar 15, thereby giving these ends different properties during play. It is therefore possible to get different effects from the club head by either lifting or lowering the club head in relation to the underlying surface. Another interchangeable part 26*a*", as shown in FIG. 7, has cylindrical end sections 27 and 28 with diameter a and a rounded concave mid-section 29".

This makes it possible to achieve a relatively high tensile strength in the tension bar 15 and a slightly lower tensile strength in the mid-section of the tension bar 15. The aim is to achieve different stroke possibilities at different heights on the tension bar 15 by lifting or lowering the club head in relation to the underlying surface.

A third modified interchangeable part 26*a*'", as shown in FIG. 8, has cylindrical end sections 27 and 28 with diameter a and a rounded convex mid-section 29'". In this case it is possible to achieve a relatively high tensile strength in the mid-section of the tension bar 15, with lower tensile strength in the end sections.

What is claimed is:

1. A golf putter comprising:

a head including end walls and defining a hollow therein;

a tension bar wrapped over forward portions of said end walls and removably attached at opposite ends thereof to each of said end walls and extending lengthwise over said hollow from one end wall to the other, said tension bar being formed of a high tensile strength material and comprising an elongated band having a main part disposed over said hollow which defines a generally vertically oriented strike area; and fastening elements having structure constructed and arranged to removably attach said opposite ends of said tension bar to each of said end walls of said head;

wherein said fastening elements include clamp plates removably securable to each of said end walls.

2. The golf putter of claim 1, wherein said tension bar is made from a material selected from the group comprising steel, metal alloy, or a material including woven fiber.

3. A golf putter comprising:

a head including end walls and defining a hollow therein;

a tension bar wrapped over forward portions of said end walls and removably attached at opposite ends thereof to each of said end walls and extending lengthwise over said hollow from one end wall to the other, said tension bar being formed of a high tensile strength material and comprising an elongated band having a main part disposed over said hollow which defines a generally vertically oriented strike area; and fastening elements having structure constructed and arranged to removably attach said opposite ends of said tension bar to each of said end walls of said head;

wherein said forward portions of said end walls comprise replaceable elements, each having a shape which imposes a lengthwise tension in said tension bar wrapped over said replaceable elements which varies in a direction transverse to the lengthwise direction.

4. The golf putter of claim 3, wherein each of said replaceable elements has a shape selected from the group comprising cylindrical, conical, concave rounded, or convex rounded.

* * * * *